US012565772B2

(12) United States Patent
Yu et al.

(10) Patent No.: US 12,565,772 B2
(45) Date of Patent: Mar. 3, 2026

(54) PRIVACY SCREEN

(71) Applicant: Archifibe Inc., Mississauga (CA)

(72) Inventors: Le Yu, Toronto (CA); Douglas Barlett, Mississauga (CA)

(73) Assignee: Archifibe Inc., Mississauga (CA)

( * ) Notice: Subject to any disclaimer, the term of this patent is extended or adjusted under 35 U.S.C. 154(b) by 544 days.

(21) Appl. No.: 18/205,350

(22) Filed: Jun. 2, 2023

(65) Prior Publication Data

US 2024/0401330 A1 Dec. 5, 2024

(51) Int. Cl.
*E04B 2/74* (2006.01)

(52) U.S. Cl.
CPC ..... *E04B 2/7425* (2013.01)

(58) Field of Classification Search
CPC ..... E04B 2/7425; E04H 15/005
See application file for complete search history.

(56) References Cited

U.S. PATENT DOCUMENTS 2,324,398 A 7/1943 Kahr
3,591,212 A * 7/1971 Rhyne ..... B27M 1/02 403/231
3,975,882 A 8/1976 Walter
4,052,828 A 10/1977 Mancini et al.
4,173,287 A * 11/1979 Kumakawa ..... B65D 9/12 403/231
4,648,231 A 3/1987 Laroche
4,709,640 A * 12/1987 Jouanin ..... A47B 47/0041 446/124
5,072,554 A * 12/1991 Hayman ..... E04H 9/12 52/79.9
5,486,042 A * 1/1996 Heisler ..... A47B 17/006 312/196
5,779,517 A * 7/1998 Clarke ..... A63H 33/044 446/108
5,903,992 A 5/1999 Eisenberg
6,746,297 B2 * 6/2004 Robjent ..... A63H 33/062 446/124

(Continued)

FOREIGN PATENT DOCUMENTS

CA 2666856 A1 11/2010
DE 102016010226 A1 * 2/2018 ..... E04H 15/005

(Continued)

*Primary Examiner* — Babajide A Demuren
(74) *Attorney, Agent, or Firm* — Carlson, Gaskey & Olds, P.C.

(57) ABSTRACT

A privacy screen including first and second rails and a screen body is provided. Each of the first and second rails has a support surface with a plurality of apertures spaced apart along a length thereof. The screen body is defined by an upper edge portion and a lower edge portion, each having a plurality of spaced apart projections formed integrally therewith and extending outwardly of and away from the screen body to define seating portions between the projections in the upper and lower edge portions. Each of the projections is dimensioned for insertion into an aperture of the first and second rails such that the seating portions between the plurality of projections are flush with the support surfaces of the first rail and second rail to affix the first and second rails to the upper and the lower edge portions of the screen body, respectively.

27 Claims, 6 Drawing Sheets

(56) References Cited

U.S. PATENT DOCUMENTS

| | | | | |
|---|---|---|---|---|
| 6,802,160 | B2 * | 10/2004 | Harambasic | E04B 1/04 446/124 |
| 6,923,705 | B2 * | 8/2005 | DeSalvo | A63H 33/044 446/124 |
| 8,365,798 | B2 | 2/2013 | Feldpausch et al. | |
| 9,512,615 | B2 | 12/2016 | MacAllen et al. | |
| 9,556,671 | B1 * | 1/2017 | Grimes | E04H 17/009 |
| 9,752,320 | B2 | 9/2017 | Bowen | |
| 9,976,301 | B2 | 5/2018 | Loffler et al. | |
| 10,000,924 | B2 | 6/2018 | Lasry et al. | |
| 10,550,581 | B2 | 2/2020 | Fjetland | |
| 10,626,602 | B2 | 4/2020 | Holbrook | |
| 11,203,882 | B2 | 12/2021 | Holdredge et al. | |
| 2005/0034398 | A1 | 2/2005 | Mauk et al. | |
| 2006/0260231 | A1 | 11/2006 | MacAllen et al. | |
| 2007/0017172 | A1 | 1/2007 | Kennedy et al. | |
| 2007/0130853 | A1 | 6/2007 | Kennedy et al. | |
| 2008/0216974 | A1 * | 9/2008 | Pitcher | G09F 15/0025 160/330 |
| 2016/0024787 | A1 | 1/2016 | Parshad | |
| 2016/0348358 | A1 * | 12/2016 | Udagawa | A47G 5/00 |
| 2020/0109558 | A1 * | 4/2020 | Schmitz | E04B 2/7433 |

FOREIGN PATENT DOCUMENTS

| | | | |
|---|---|---|---|
| EP | 1811095 | A2 | 7/2007 |
| JP | 3235002 | U * | 11/2021 |
| WO | 2022013319 | A1 | 1/2022 |

* cited by examiner

PRIVACY SCREEN

TECHNICAL FIELD

The present disclosure relates to a privacy screen and particularly to a privacy screen for dividing open plan spaces.

BACKGROUND

Modern interior spaces, such as office and residential interior spaces, often feature open concept floor plans. While aesthetically pleasing, such spaces pose a number of challenges to occupants. In such spaces, it can be difficult to achieve a desired level of privacy. Moreover, open concept spaces often have numerous acoustically reflective surfaces such as floors, walls, ceilings, window walls, large displays, and furnishings, to name a few. Ambient sound within an open concept space can often result in noise and auditory distractions as it is reflected about the space.

Room dividers or privacy screens are known for use in such office and residential environments to provide a visual divide and limit auditory distractions. Typically, such privacy screens may be relatively large, heavy, and cumbersome, thereby making it difficult to set-up, take-down or store the privacy screen. Moreover, such privacy screens may not be flexible or adjustable, and have limits on the extent to which they can be reshaped or resized to suit varying spaces and requirements.

It may be desirable to have a privacy screen which would be able to help divide and reshape the space on a temporary basis to limit visible and auditory distractions with little impact on the ambience of a modern office or residential space.

BRIEF SUMMARY

The present disclosure relates to a privacy screen and particularly to a privacy screen for dividing open plan spaces.

In one aspect, there is provided a privacy screen comprising a first rail extending in a longitudinal direction, the first rail having a first support surface with a first plurality of apertures spaced apart along a length thereof, and a second rail extending in the longitudinal direction, the second rail having a second support surface with a second plurality of apertures spaced apart along a length thereof. The privacy screen further comprises a screen body extending longitudinally between a first edge portion and a second edge portion opposite the first edge portion, the screen body further having an upper edge portion and a lower edge portion, each of the upper edge portion and the lower edge portion extending between the first and second edge portions, the screen body having a first plurality of spaced apart projections formed integrally therewith along the upper edge portion and a second plurality of spaced apart projections formed integrally therewith along the lower edge portion, wherein the first and second plurality of spaced apart projections extend outwardly of and away from the upper edge portion and lower edge portion, respectively, to define seating portions between the projections in the upper edge portion and the lower edge portion. Each of the first plurality of projections is dimensioned for insertion into an aperture of the first plurality of apertures such that the seating portions between the first plurality of projections are flush with the first support surface of the first rail to affix the upper edge portion of the screen body to the first rail, and each of the second plurality of projections is dimensioned for insertion into an aperture of the second plurality of apertures such that the seating portions between the second plurality of projections are flush with the second support surface of the second rail to affix the lower edge portion of the screen body to the second rail. In one aspect, each of the first plurality of projections is dimensioned for insertion into the respective aperture of the first plurality of apertures in interference fit relation, and each of the second plurality of projections is dimensioned for insertion into the respective aperture of the second plurality of apertures in interference fit relation.

In one aspect, the privacy screen is composed of a semi-rigid material. In a further aspect, the semi-rigid material is one selected from the group consisting of polyethylene terephthalate (PET), polypropylene, and non-woven acoustic insulation material.

In one aspect, the screen body conforms to a shape of the first rail and the second rail. In a further aspect, the screen body comprises a plurality of grooves each extending between the upper edge portion and the lower edge portion. The plurality of grooves are formed on at least one of a front side and a rear side of the screen body. In a further aspect, the plurality of grooves are parallel to one another and to the first and second edge portions between the upper edge portion and the lower edge portion.

In one aspect, the privacy screen further comprises a cap trim extending in the longitudinal direction and having a plurality of slots spaced apart therealong, wherein each slot of the plurality of slots is dimensioned for insertion of a respective projection of the first plurality of spaced apart projections of the screen body extending through a respective aperture of the first plurality of apertures of the first rail such that the cap trim is removably coupled with the projections and in abutment relationship with the first rail therealong. In a further aspect, each slot of the plurality of slots is dimensioned for insertion of the respective projection of the first plurality of spaced apart projections of the screen body extending through the respective aperture of the first plurality of apertures of the first rail in interference fit relation.

In one aspect, the privacy screen further includes a first edge trim removably couplable to the first edge portion of the screen body, and a second edge trim removably couplable to the second edge portion of the screen body. In a further aspect, the first and second edge portions of the screen body include a plurality of tabs spaced apart therealong, and the first and second edge trims comprise a plurality of edge trim slots spaced apart along a length thereof, wherein each tab of the plurality of tabs is dimensioned for insertion into a respective edge trim slot of the plurality of edge trim slots to couple the first edge trim and the second edge trim to the first edge portion and the second edge portion, respectively. Each tab of the plurality of tabs is dimensioned for insertion into the respective edge trim slot of the plurality of edge trim slots in interference fit relation. In a further aspect, a width of the each of the first rail and the second rail is equal to a width of the first edge trim and the second edge trim.

In a further aspect, the first edge trim includes a first protrusion at a first end portion thereof and a second protrusion at a second end portion thereof, the second edge trim includes a third protrusion at a first end portion thereof and a fourth protrusion at a second end portion thereof, the first rail includes a first recess at a first end portion thereof and a second recess at a second end portion thereof, the second rail includes a third recess at a first end portion thereof and a fourth recess at a second end portion thereof.

In a still further aspect, the first protrusion is dimensioned for insertion into the first recess such that the first end portion of the first edge trim is coupled to the first end portion of the first rail, the second protrusion is dimensioned for insertion into the third recess such that the second end portion of the first edge trim is coupled to the first end portion of the second rail, the third protrusion is dimensioned for insertion into the second recess such that the first end portion of the second edge trim is coupled to the second end portion of the first rail, and the fourth protrusion is dimensioned for insertion into the fourth recess such that the second end portion of the second edge trim is coupled to the second end portion of the second rail. In a further aspect, the first protrusion is dimensioned for insertion into the first recess in interference fit relation, the second protrusion is dimensioned for insertion into the third recess in interference fit relation, the third protrusion is dimensioned for insertion into the second recess in interference fit relation, and the fourth protrusion is dimensioned for insertion into the fourth recess in interference fit relation.

In another aspect, there is provided a privacy screen comprising at least one upper rail and at least one lower rail, each extending in a longitudinal direction and having a support surface with a plurality of apertures spaced apart along a length thereof, and at least one screen body extending longitudinally between a first edge portion and a second edge portion opposite the first edge portion, the at least one screen body further having an upper edge portion and a lower edge portion, each of the upper edge portion and the lower edge portion extending between the first and second edge portions, the at least one screen body having a plurality of spaced apart projections formed integrally therewith along the upper edge portion and the lower edge portion, wherein the plurality of spaced apart projections extend outwardly of and away from the upper edge portion and lower edge portion to define seating portions between the projections in the upper edge portion and the lower edge portion, wherein the plurality of projections on the upper edge portion are dimensioned for insertion into the plurality of apertures on the at least one upper rail such that the seating portions between the projections are flush with the support surface of the at least one upper rail to affix the upper edge portion to the at least one upper rail, and wherein the plurality of projections on the lower edge portion are dimensioned for insertion into the plurality of apertures on the at least one lower rail such that the seating portions between the projections are flush with the support surface of the at least one lower rail to affix the lower edge portion to the at least one lower rail.

In a further aspect, the plurality of projections on the upper edge portion are dimensioned for insertion into the plurality of apertures on the at least one upper rail in interference fit relation, and wherein the plurality of projections on the lower edge portion are dimensioned for insertion into the plurality of apertures on the at least one lower rail in interference fit relation.

In a further aspect, the at least one screen body comprises a first screen body and a second screen body. The privacy screen further comprises at least one joining trim configured to removably couple the first screen body with the second screen body. In a further aspect, the at least one joining trim is secured to the first screen body and the second screen body using at least one of adhesives and two-sided tape.

In a further aspect, the at least one upper rail comprises a first upper end rail, an upper mid rail, and a second upper end rail, wherein the upper mid rail is positionable between the first upper end rail and the second upper end rail along a portion of the upper edge portion of each of the first screen body and the second screen body, and the at least one lower rail comprises a first lower end rail, a lower mid rail, and a second lower end rail, wherein the lower mid rail is positionable between the first lower end rail and the second lower end rail along a portion of the lower edge portion of each of the first screen body and the second screen body.

In the further aspect, the privacy screen includes at least one cap trim extending in the longitudinal direction and having a plurality of slots spaced apart therealong, wherein each slot of the plurality of slots is dimensioned for insertion of a respective projection of the plurality of spaced apart projections of the screen body extending through a respective aperture of the plurality of apertures of the at least one upper rail such that the at least one cap trim is removably coupled with the projections and in abutment relationship with the at least one upper rail therealong. In a still further aspect, each slot of the plurality of slots is dimensioned for insertion of the respective projection of the plurality of spaced apart projections of the screen body extending through the respective aperture of the plurality of apertures of the at least one upper rail in interference fit relation.

In a further aspect, the privacy screen includes a first edge trim removably couplable to the first edge portion of the first screen body, and a second edge trim removably couplable to the second edge portion of second screen body, wherein the first edge trim is removably couplable to a first end portion of the first upper end rail and a first end portion of the first lower end rail, and wherein he second edge trim is removably couplable to a second end portion of the second upper end rail and a second end portion of the second lower end rail.

In another aspect, there is provided a privacy screen kit including at least one upper rail extending in a longitudinal direction, the upper rail having a first support surface with a first plurality of apertures spaced apart along a length thereof, at least one lower rail extending in the longitudinal direction, the lower rail having a second support surface with a second plurality of apertures spaced apart along a length thereof, and at least one screen body extending longitudinally between a first edge portion and a second edge portion opposite the first edge portion, the at least one screen body further having an upper edge portion and a lower edge portion, each of the upper edge portion and the lower edge portion extending between the first and second edge portions, the at least one screen body having a plurality of spaced apart projections formed integrally therewith along the upper edge portion and the lower edge portion, wherein the plurality of spaced apart projections extend outwardly of and away from the upper edge portion and lower edge portion to define seating portions between the projections in the upper edge portion and the lower edge portion, wherein the plurality of projections on the upper edge portion are dimensioned for insertion into the first plurality of apertures on the at least one upper rail, and the plurality of projections on the lower edge portion are dimensioned for insertion into the second plurality of apertures on the at least one lower rail to form a privacy screen structure.

In a further aspect, the plurality of projections on the upper edge portion are dimensioned for insertion into the first plurality of apertures on the at least one upper rail in interference fit relation, and the plurality of projections on the lower edge portion are dimensioned for insertion into the second plurality of apertures on the at least one lower rail in interference fit relation to form the privacy screen structure.

BRIEF DESCRIPTION OF THE DRAWINGS

Exemplary non-limiting aspects are described with reference to the accompanying drawings in which.

DETAILED DESCRIPTION

The present disclosure relates to a privacy screen and particularly to a privacy screen for dividing open plan spaces.

Figure 1:
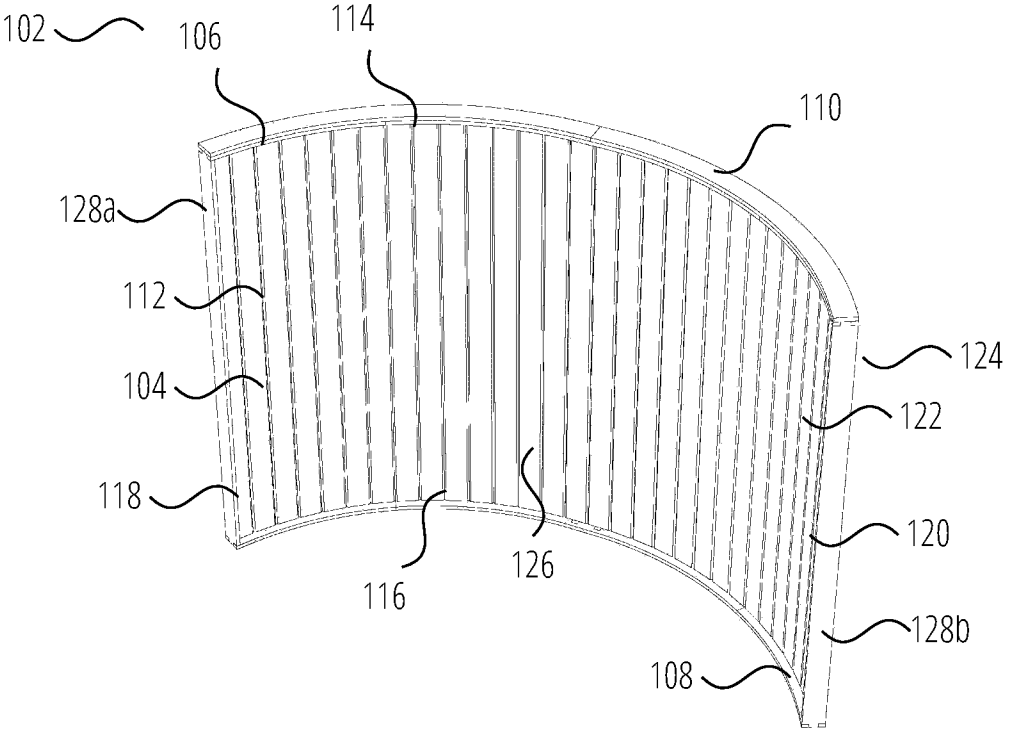
FIG. 1 is a perspective view of a privacy screen according to one aspect.

FIG. 1 illustrates one aspect of a privacy screen 102. The privacy screen 102 includes a screen body 104 removably coupled with a first rail 106. The first rail 106 extends along at least a substantial portion of the length of the top of the screen body 104 to help define a shape of the privacy screen 102. The screen body 104 is also removably coupled to a second rail 108 that extends along a substantial portion of the length of the bottom of the screen body 104 to further define a shape of the privacy screen 102. The privacy screen 102 is a free-standing or self-supporting structure that can be placed on the floor or any similar work surface. In one aspect, a cap trim 110 is coupled to the first rail 106.

The first rail 106 and second rail 108 are rigid members extending in a longitudinal direction and have the function of defining the shape of the privacy screen 102 as the screen body 104 is configured to conform to the shape of the first rail 106 and the second rail 108. The first rail 106 and second rail 108 may extend in any particular shape along its length, such as a curved C-shape or a S-shape, a linearly elongated shape, or a conventional rectilinearly angled L-shape or Z-shape. Preferably, the first rail 106 and the second rail 108 are composed of a semi-rigid or rigid material. Suitable materials may include, for example, various types of polyethylene terephthalate (PET) material, including woven PET fiber material, non-woven PET fiber material, thermoformed PET material, thermo-bonded PET material, cast PET material. Suitable materials also include other acoustically absorbent materials including polypropylene, polymer foams, other suitable non-woven acoustic insulation materials, or any combinations thereof. The rigidity or resilience of the first rail 106 and the second rail 108 can help define the shape of the privacy screen 102 and can help ensure that the screen body 104 is able to freely stand on a floor or any other work surface. In one aspect, the first rail and the second rail have a rectangular cross-section.

The screen body 104 extends longitudinally between a first edge portion 118 and a second edge portion 120 opposite to the first edge portion 118. The first edge portion 118 and the second edge portion 120 are preferably laterally disposed opposite one another about the screen body 104. The screen body 104 is further defined by an upper edge portion 114 and a lower edge portion 116. The screen body 104 is flexible so as to conform to the shape of the first rail 106 and/or the second rail 108 that may be coupled to the screen body 104. Preferably, the screen body 104 is composed of a semi-rigid material. Suitable materials may include those that are acoustically absorbent and sufficiently flexible to allow the screen body 104 to be molded to take the shape of the first rail 106 and/or the second rail 108 when the screen body 104 is coupled to the first rail 106. Such materials include, for example, polyethylene terephthalate (PET), polypropylene, other suitable non-woven acoustic insulation materials, or any combinations thereof.

The screen body 104 further includes a plurality of grooves 112 extending between the upper edge portion 114 and the lower edge portion 116. The screen body 104 can be configurable in various different orientations by bending or flexing the screen body 104 along at least some of the plurality of grooves 112. The grooves 112 in the screen body 104 allow the screen body 104 to be more flexible to conform to the shape of the first and second rails 106, 108 when the screen body 104 is coupled to the first and second rails 106, 108.

The grooves 112 may be formed, for example, by cutting the material from which the screen body 104 is composed. Preferably, the grooves 112 are parallel to one another. It is further preferred that the grooves 112 are also parallel to the first lateral edge portion 118 and the second lateral edge edge portion 120 of the screen body 104. In one aspect, the grooves 112 are beveled and formed on both a front side 122 and a back or rear side 124 of the screen body 104 to form a double-V groove. It should be understood that other types of grooves may be used to define the grooves 112. The plurality of grooves 112 divide the screen body 104 into a series of spaced apart panel regions 126 extending from the upper edge portion 114 to the lower edge portion 116 of the screen body 104. Immediately adjacent panel regions 126 may be spaced apart by one of the plurality of grooves 112. The panel regions 126 of the screen body 104 may have a width W that is greater than a width w of the grooves 112. The panel regions 126 may also have a thickness T that is greater than the thickness t of the grooves 112.

In one aspect, the first rail 106, the second rail 108, and the cap trim 110 are unitary members extending along a substantial portion of the upper and lower edge portions 114, 116 of the screen body 104. In another aspect, each of the first rail 106, second rail 108, and the cap trim 110 may be composed of multiple members arranged in a linear or sequential configuration.

Privacy screen 102 also includes a first edge trim **128*a* removably coupled to the first lateral edge portion 118 of the screen body 104 and a second edge trim 128*b* removably coupled to the second lateral edge portion 120 of the screen body 104. The first edge trim 128*a* is also removably coupled to the first rail 106 at a first end and the second rail 108 at a second end. Similarly, a first end of the second edge trim 128*b* is removably coupled to the first rail 106 and a second end of the second edge trim 128*b* is removably coupled to the second rail 108**.

Figure 2B:
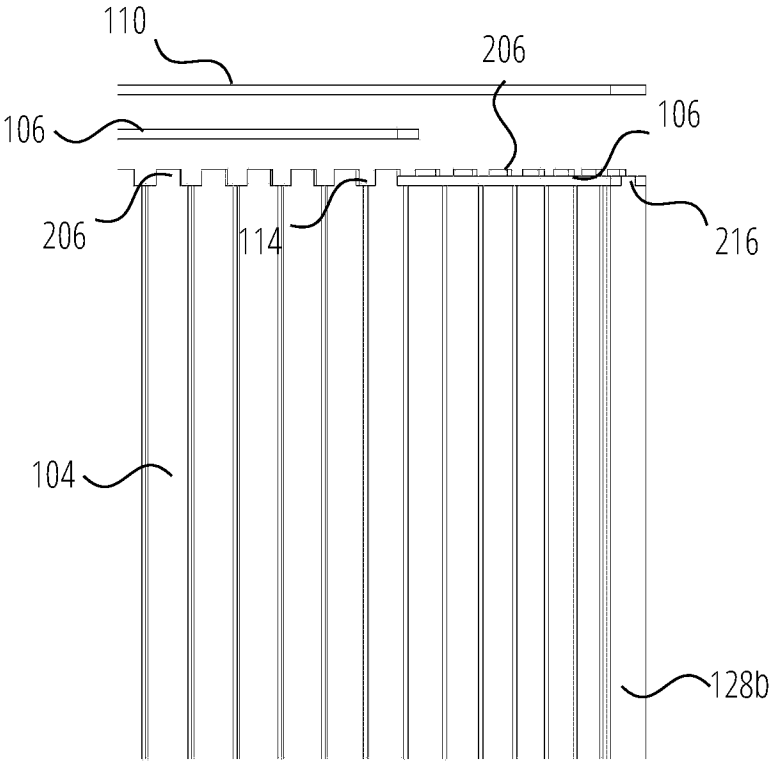
FIG. 2B illustrates a partially exploded perspective view of a portion of the privacy screen of FIG. 1.
Figure 2A:
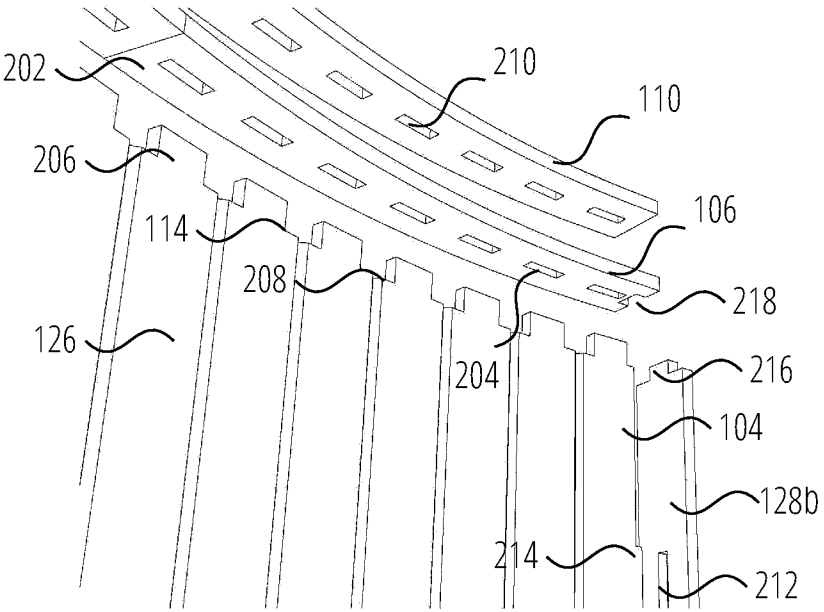
FIG. 2A illustrates an exploded perspective view of a portion of the privacy screen of FIG. 1.

With further reference to FIGS. 2A and 2B, the first rail 106 is a rigid member extending in a longitudinal direction to define a support surface 202. As illustrated in FIG. 2A, the first rail 106 includes a plurality of apertures 204 passing therethrough. The apertures 204 are spaced apart along a length of the support surface 202 of the first rail 106. Preferably, the apertures 204 have a rectangular cross-section. It should be understood that other suitable shapes may be used to define the apertures 204. In one aspect, the second rail 108 is identical to the first rail 106 and includes a plurality of apertures (not shown) spaced apart along a length of the second rail 108.

The screen body 104 further includes a series of projections 206 integrally formed with the screen body 104. The series of projections 206 extend outwardly of and away from at least one of the upper edge portion portion 114 and the lower edge portion portion 116 (not shown in FIGS. 2A and 2B) of the screen body 104. The plurality of projections 206 are spaced apart along the length of the upper and/or lower edge portions to define seating portions 208 between the projections in the upper and/or lower edge portions 114, 116. In one aspect, the projections 206 extend outwardly from the upper edge portion 114 and/or the lower edge portion 116 of the panel regions 126 of the screen body 104. The projections 206 may have the same thickness T as the panel regions 126. Each of the projections 206 is dimensioned for insertion into an aperture 204 of the first rail 106 such that the seating portions 208 between the projections are flush with the support surface 202 of the first rail 106 to affix the screen body 104 to the first rail 106 with the flexible screen body 104 conforming to a shape of the first rail 106. Each of the projections 206 is preferably dimensioned for insertion into an aperture 204 of the first rail 106 in an interference fit such that the seating portions 208 between the projections are flush with the support surface 202 of the first rail 106. The term "interference fit" includes a compression fit or friction fit relation.

In one aspect, the height H of each of the plurality of projections 206 extending from the screen body 104 is equal to a depth D of each of the plurality of apertures 204 on the first rail 106 and/or the second rail such that the top of the projections 206 is flush with the first rail 106 and/or second rail 108 when the body 104 is coupled to the first rail 106 and/or second rail 108. The number of projections 206 on the screen body 104 is preferably equal to the number of apertures 204 on the first rail and/or second rail 108.

In another aspect, as shown in FIG. 2B, the height H of each of the plurality of projections 206 extending from the upper edge portion 114 of the screen body 104 is greater than a depth D of each of the plurality of apertures 204 on the first rail 106 such that a top portion of the projections 206 extends past the first rail 106 when the screen body 104 is coupled to the first rail 106.

As shown in FIGS. 2A and 2B, the privacy screen 102 further includes a cap trim 110 extending in a longitudinal direction. The cap trim 110 can be removably coupled to the first rail 106. The cap trim 110 includes a plurality of slots 210 spaced apart along a length of the cap trim 110, each slot 210 dimensioned for fitting a respective projection 206 extending past the first rail 106 such that a bottom surface of the cap trim 110 is flush with or in continuous contact with a top surface of the first rail 106. In one aspect, the slots 210 are dimensioned for fitting a respective projection 206 in an interference fit relation, or a press fit relation, or a friction fit relation. When the cap trim 110 is coupled to the first rail 106 and the screen body 104, the plurality of apertures on the first rail 106 and the plurality of projections 206 of the screen body are concealed. The cap trim improves the aesthetic quality of the screen by concealing the apertures and projections. The combination of the cap trim 110 coupled with the first rail 106 may also allow for a more rigid or stable structure.

In a further aspect, the first edge trim 128*a* (not shown in FIGS. 2A and 2B) and the second edge trim 128*b* are removably couplable to the screen body 104. The first and second edge trims 128*a*, 128*b* have a plurality of edge trim slots 212 spaced apart along a length thereof that are removably couplable to a plurality of tabs 214 spaced apart along the first and second lateral edge portions 118, 120 of the screen body 104 in an interference fit relation or a friction fit relation or a compression fit relation. Each of the first and second edge trims 128*a*, 128*b* also include a protrusion 216 extending outwardly of and away from a first and second end thereof. Each of the first rail 106 and the second rail 108 include a recess 218 at a first and second end portion thereof. The protrusions 216 are dimensioned for insertion into a corresponding one of the recesses 218 in an interference fit relation or a friction fit relation therewith to removably couple each of the first and second edge trims to each of the first and second rails 106, 108.

Figure 3A:
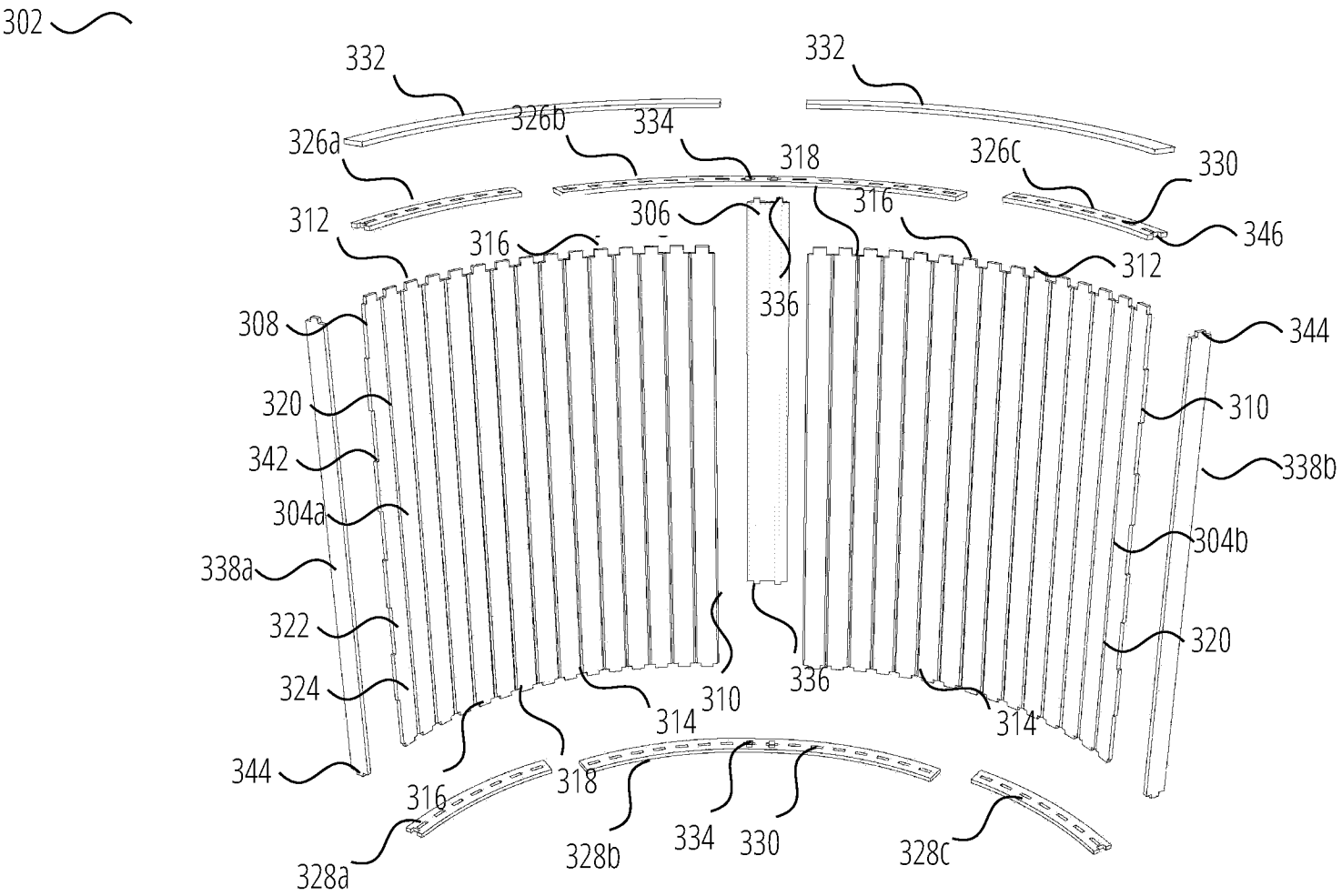
FIG. 3A is an exploded front perspective view of a privacy screen according to a second aspect.
Figure 3B:
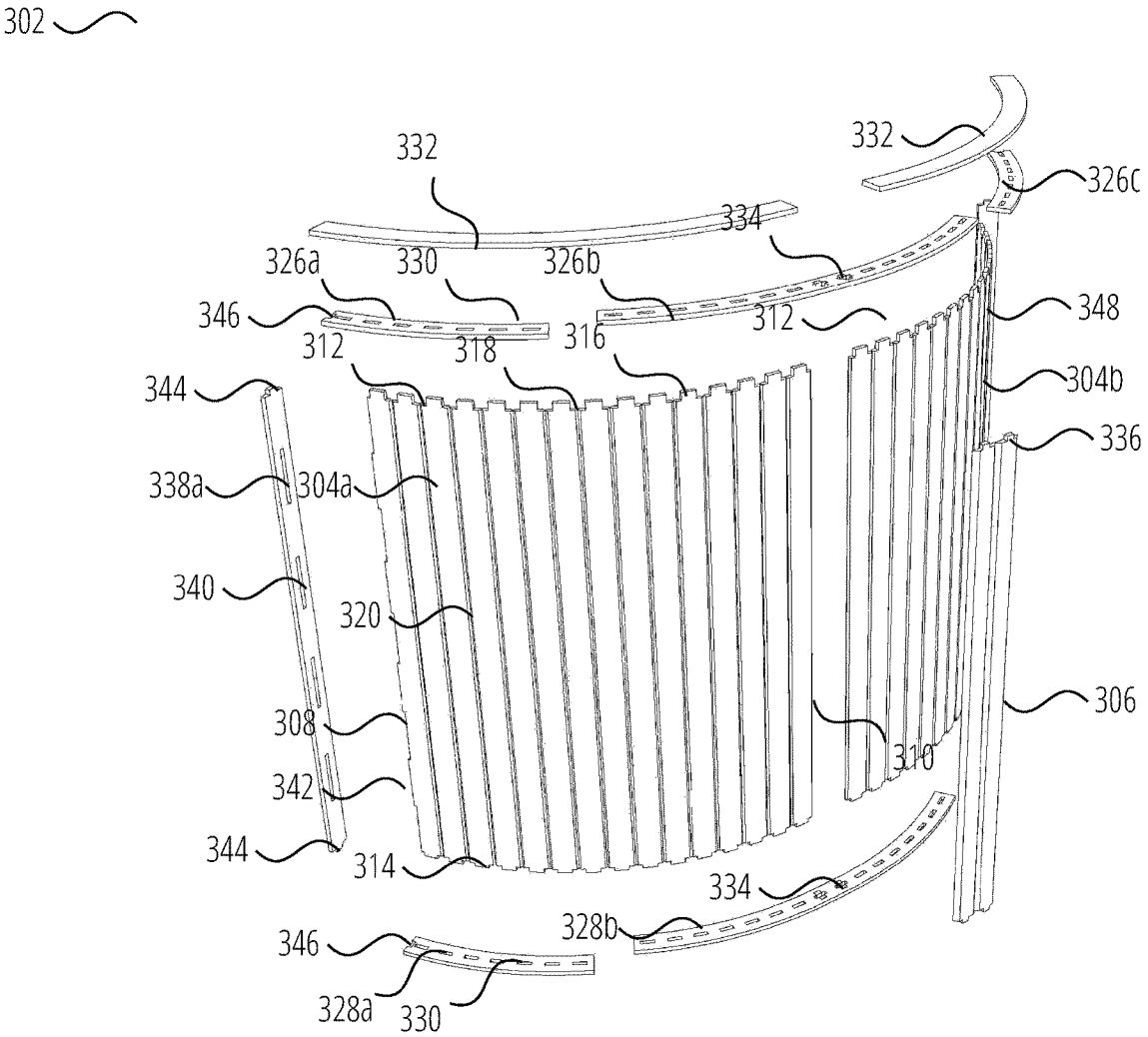
FIG. 3B illustrates an exploded back perspective view of the privacy screen of FIG. 3A.

In a further aspect, a privacy screen can be formed by coupling together multiple screen bodies, rails, and cap trims to create a larger structure. Reference is made to FIGS. 3A and 3B which illustrate an exploded perspective view of a second aspect of a privacy screen 302. Privacy screen 302 includes a first screen body 304*a* and a second screen body 304*b* removably couplable via a joining trim 306. In one aspect, the joining trim 306 is further secured to the first screen body 304*a* and the second screen body 304*b* using an adhesive or a two-sided tape. Each of the first and second screen bodies 304*a*, 304*b* extends longitudinally between a first lateral edge portion 308 and a second lateral edge portion 310 opposite to the first lateral edge portion 308. Each of the screen bodies 304*a-b* is further defined by an upper edge portion 312 and a lower edge portion 314. In one aspect, the first screen body 304*a* is identical to the second screen body 304*b*. In another aspect, the first screen body 304*a* is different in size or dimension from the second screen body 304*b*. It should be understood that while a combination of two screen bodies is illustrated in FIGS. 3A and 3B, a single screen body or more than two screen bodies can be used to form the privacy screen 302.

Each of the screen bodies 304*a-b* includes a plurality of grooves 320 extending between the upper edge portion 312 and the lower edge portion 314. The first and second screen bodies 304*a*, 304*b* can be configurable in various different orientations by bending or flexing the first and second screen bodies 304*a*, 304*b* along at least some of the plurality of grooves 320. The grooves 320 may be formed by cutting the material from which the first and second screen bodies 304*a*, 304*b* are composed. Preferably, the grooves 320 are parallel to one another. It is further preferred that the grooves 320 are also parallel to the first lateral edge portion 308 and the second lateral edge edge portion 310 of the screen bodies 304*a-b*. In one aspect, the grooves 320 are beveled and formed on both a front side 322 and a back or rear side 348 of the first and second screen bodies 304*a*, 304*b* to form a double-V groove. It should be understood that other types of grooves may be used to define the grooves 320. The plurality of grooves 320 divide each of the first and second screen bodies 304*a*, 304*b* into a series of spaced apart panel regions 324 extending from the upper edge portion 312 to the lower edge portion 314 of the screen body 304. The panel regions 324 of the first and second screen bodies 304*a*, 304*b* may have a width W that is greater than a width w of the grooves 320. The panel regions 324 may also have a thickness T that is greater than the thickness t of the grooves 320.

Each of the first and second screen bodies 304*a*, 304*b* further includes a series of projections 316 integrally formed therewith. The series of projections 316 extend outwardly of and away from the upper edge portion 312 and the lower edge portion 314 of the screen bodies 304*a-b*. The plurality of projections 316 are spaced apart along the length of the upper and lower edge portions 312, 314 to define seating portions 318 between the projections in the upper and/or lower edge portions 114, 116. The projections 316 have the same thickness T as the panel regions 324. In one aspect, the projections 316 on the upper edge portion 312 have the same height as the projections 316 on the lower edge portion 314.

In another aspect, the height of the projections 316 on the upper edge portion 312 is greater than a height of the projections 316 on the lower edge portion 314.

The privacy screen 302 further includes multiple rails that can be removably coupled to the first and second screen bodies 304*a*, 304*b*. As illustrated in FIG. 3A, the privacy screen includes a first upper end rail 326*a*, an upper mid rail 326*b*, and a second upper end rail 326*c*, each removably couplable to a portion of the upper edge portion 312 of the first and second screen bodies 304*a*, 304*b*. The upper mid rail 326*b* is positionable between the first upper end rail 326*a* and the second upper end rail 326*c* such that it is removably coupled to a portion of the upper edge portion 312 of each of the first screen body 304*a* and the second screen body 304*b*. The privacy screen 302 further includes a first lower end rail 328*a*, a lower mid rail 328*b*, and a second lower end rail 328*c*, each removably couplable to a portion of the lower edge portion 314 of the first and second screen bodies 304*a*, 304*b*. The lower mid rail 328*b* is positionable between the first lower end rail 328*a* and the second lower end rail 328*c* such that it is removably coupled to a portion of the lower edge portion 314 of each of the first screen body 304*a* and the second screen body 304*b*. In one aspect, the first upper end rail 326*a*, the second upper end rail 326*c*, the first lower end rail 328*a*, and the second lower end rail 328*c* are identical to each other. In a further aspect, the upper mid rail 326*b* is identical to the lower mid rail 328*b*. It should be noted that while a combination of three rails is illustrated in FIG. 3A, a single rail, two rails, or more than three rails can be used to form the privacy screen.

Each of the upper and lower rails 326*a-c* and 328*a-c* include a plurality of apertures 330 passing therethrough. The apertures 330 are spaced apart along a length of each of the upper and lower rails 326*a-c* and 328*a-c*. Preferably, the apertures 330 have a rectangular cross-section. It should be understood that other suitable shapes may be used to define the apertures 330. Each of the upper mid rail 326*b* and lower mid rail 328*b* further include at least one aperture 334 dimensioned for coupling with a protrusion 336 on the joining trim 306. In one aspect, the at least one aperture 334 is dimensioned for coupling with the protrusion 336 on the joining trim 306 in an interference fit, compression fit or friction fit relation.

Each of the projections 316 on the first and second screen bodies 304*a*, 304*b* is dimensioned for insertion into an aperture 330 each of the upper and lower rails 326*a-c* and 328*a-c* in an interference fit, compression fit or friction fit relation such that the seating portions 318 between the projections 316 are flush with a surface of the each of the upper and lower rails 326*a-c* and 328*a-c* to affix the screen body 304 to each of the upper and lower rails 326*a-c* and 328*a-c*.

In one aspect, the height H of each of the plurality of projections 316 extending from the first and second screen bodies 304*a*, 340*b* is equal to a depth D of each of the plurality of apertures 330 on each of the upper and lower rails 326*a-c* and 328*a-c* such that the end of the projections 316 is flush with each of the upper and lower rails 326*a-c* and 328*a-c* when the screen bodies 304*a-b* are coupled to the upper and lower rails 326*a-c* and 328*a-c*. In a further aspect, the total number of projections 316 on the screen bodies 304*a-b* is equal to the total number of apertures 330 on the upper and lower rails 326*a-c* and 328*a-c*.

In one aspect, the height of the projections extending from the upper edge portion 312 of the screen bodies 304*a-b* is greater than the height of the projections extending from the lower edge portion 314 of the screen bodies 304*a-b*. In this aspect, the height of each of the plurality of projections 316 extending from the upper edge portion 312 of the screen bodies 304*a-b* is greater than a depth of each of the plurality of apertures 330 on each of the upper rails 326*a-c* such that the top of the projections 316 extends past each of the upper rails 326*a-c* when the screen body 304 is coupled to the upper rails 326*a-c*. In a further aspect, the height of each of the plurality of projections 316 extending from the lower edge portion 314 of the screen bodies 304*a-b* is equal to a depth of each of the plurality of apertures 330 on each of the lower rails 328*a-c* such that the end of the projections 316 is flush with each of the lower rails 328*a-c* when the screen bodies 304*a-b* are coupled to the lower rails 328*a-c*.

The privacy screen 302 further includes two cap trims 332 extending in a longitudinal direction. The cap trims 332 can be removably coupled to the upper rails 326*a-c* and the screen bodies 304*a-b*. The cap trims 332 include a plurality of slots (not shown in FIG. 3A, but shown as slots 210 in FIG. 2A) spaced apart along a length of the cap trims 332, each slot 210 dimensioned for fitting a respective projection 316 extending past each of the upper rails 326*a-c* in an interference fit, compression fit or friction fit relation such that a bottom surface of the cap trims 332 is flush with or in continuous contact with a top surface of each of the upper rails 326*a-c*. It should be understood that while a combination of two rails is illustrated in FIG. 3A, either a single rail or more than two rails can be used to form the privacy screen.

The privacy screen 302 further includes a first edge trim 338*a* removably coupled to the first lateral edge portion 308 of the first screen body 304*a*. A second edge trim 338*b* is removably coupled to the second lateral edge portion 310 of the second screen body 304*b*. As shown in FIG. 3B, the first edge trim 338*a* has a plurality of edge trim edge trim slots 340 spaced apart along a length thereof that are removably couplable to tabs 342 spaced apart along the first lateral edge portion 308 of the first screen body 304*a*. Similarly, the second trim 338*b* has a plurality of edge trim slots (not shown) spaced apart along a length thereof that are removably couplable to tabs on the second lateral edge portion 310 of the second screen body 304*b*. Each of the tabs 342 is dimensioned for insertion into a respective slot 340 in an interference fit, compression fit or friction fit relation to couple the first edge trim 338*a* and the second edge trim 338*b* to the first lateral edge portion 308 of the first screen body 304*a* and the second lateral edge portion 310 of the second screen body 304*b*, respectively.

In a further aspect, the first edge trim 338*a* may be additionally removably coupled to the first upper end rail 326*a* and the first lower end rail 328*a*. Similarly, the second edge trim 338*b* may be additionally removably coupled to the second upper end rail 326*c* and the second lower end rail 328*c*. The first edge trim 338*a* includes a tab 344 extending from each of a first end and a second end thereof. The second edge trim 338*b* includes a tab 344 extending from each of a first end and a second end thereof. Each of the upper end rails 326*a*, 326*c* and each of the lower end rails 328*a*, 328*c* includes a recess 346 at one end thereof. The recess 346 on each of the upper and lower end rails 326*a*, 326*c*, 328*a*, 328*c* is dimensioned for insertion of the tab 344 in an interference fit, compression fit or friction fit relation such that the first edge trim 338*a* is coupled to the first upper and lower end rails 326*a*, 328*a*, and second edge trim 338*b* is coupled to the second upper and lower end rails 326*c*, 328*c*. In one aspect, a width of each of the upper and lower rails 326*a-c*, 328*a-c* is equal to a width of the first and second edge trims 338*a*, 338*b*.

Figure 4:
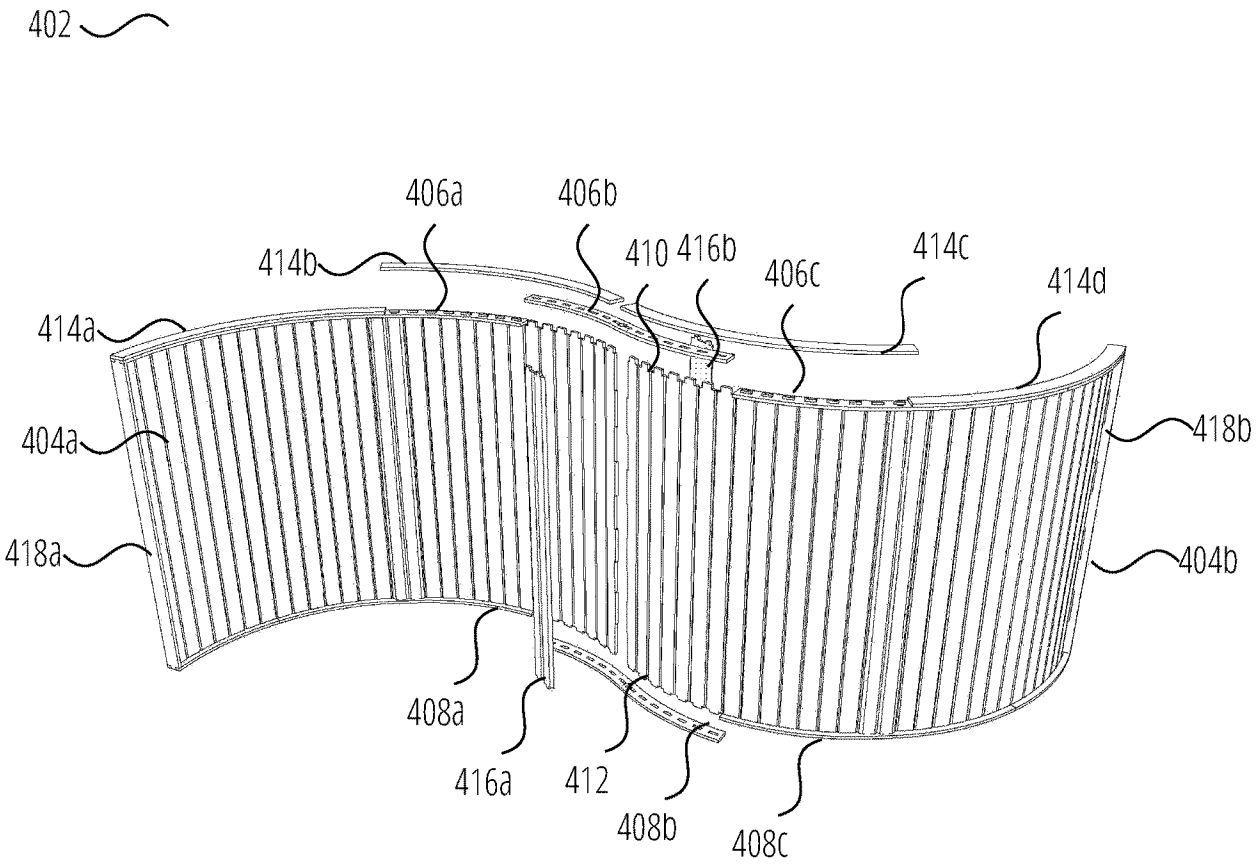
FIG. 4 illustrates an S-shaped privacy screen according to one aspect.

In the aspect illustrated in FIG. 4, there is shown an S-shaped privacy screen 402. Privacy screen 402 includes a first screen body 404*a* and a second screen body 404*b* removably couplable to three upper mid rails 406*a-c* on an upper edge portion 410 of the screen bodies 404*a*, 404*b* in an interference fit, compression fit or friction fit relation as discussed above with regard to FIGS. 1-3 to form the S-shape of the privacy screen 402. The two screen bodies 404*a*, 404*b* are also removably couplable to three lower mid rails 408*a-c* on a lower edge portion 412 of the screen bodies 404*a*, 404*b* in an interference fit, compression fit or friction fit relation. The three upper mid rails 406*a-c* are also removably coupled to four cap trims 414*a-d* in an interference fit, compression fit or friction fit relation. The privacy screen 402 further includes two joining trims 416*a* and 416*b* that are removably couplable to the screen bodies 404*a-b*. In one aspect, each of the two joining trims 416*a* and 416*b* are further secured to the first screen body 404*a* and the second screen body 404*b* using an adhesive or a two-sided tape. Each of the joining trims 416*a* and 416*b* also include protrusions extending from an end thereof that are dimensioned for coupling with respective apertures on the upper and lower mid rails, respectively, for vertical and lateral positioning. A first edge trim 418*a* is removably coupled to a first lateral edge portion of the first screen body 404*a* and a second edge trim 418*b* is removably coupled to a second lateral edge portion of the second screen body 404*b*.

Figure 5:
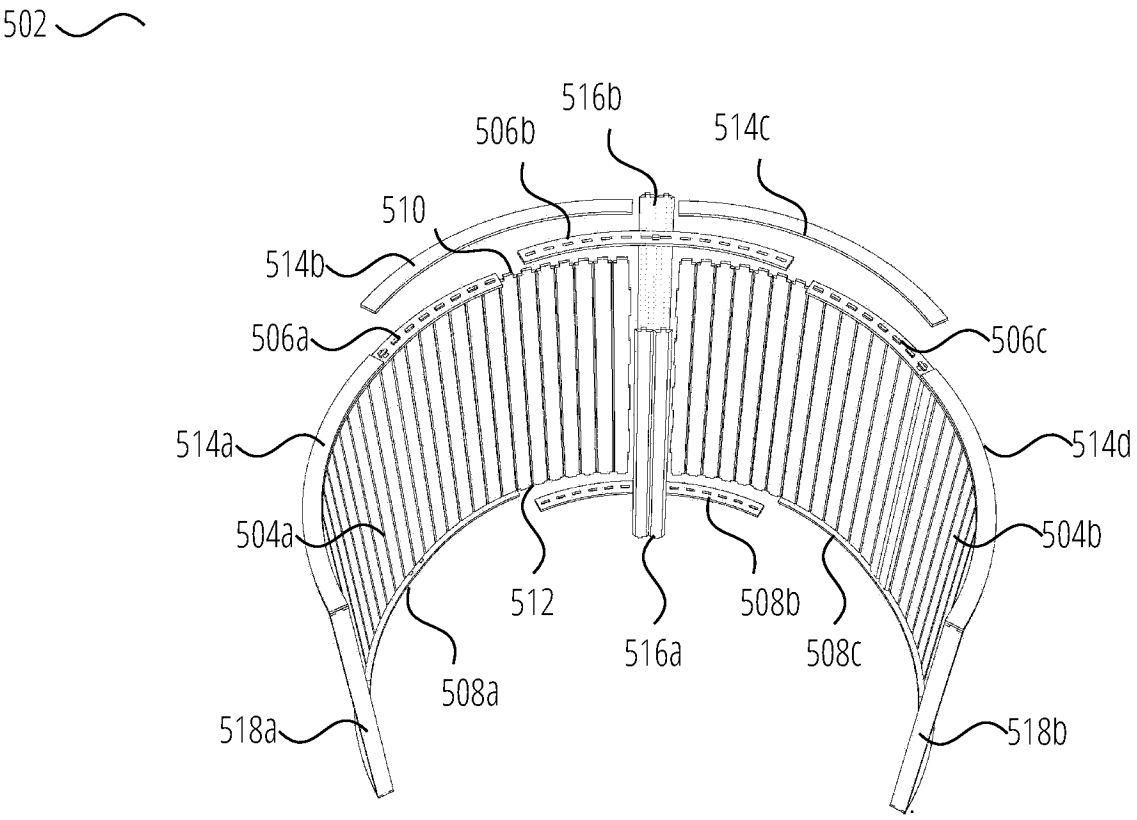
FIG. 5 illustrates a C-shaped privacy screen according to one aspect.

In the aspect illustrated in FIG. 5 there is shown a C-shaped privacy screen 502. Privacy screen 502 includes a first screen body 504*a* and a second screen body 504*b* removably couplable to three upper mid rails 506*a*, 506*b*, 506*c* on an upper edge portion 510 of the screen bodies in an interference fit, compression fit or friction fit relation as discussed above with regard to FIGS. 1-3 to form the C-shape of the privacy screen 502. The two screen bodies 504*a*, 504*b* are also removably couplable to three lower mid rails 508*a*, 508*b*, 508*c* on a lower edge portion 512 of the screen bodies 504*a*, 504*b* in an interference fit, compression fit or friction fit relation. The first and second screen body 504*a*, 504*b* and three upper mid rails 506*a*, 506*b*, 506*c* are also removably coupled to four cap trims 514*a*, 514*b*, 514*c*, 514*d* in an interference fit, compression fit or friction fit relation. The privacy screen 502 further includes two joining trims 516*a* and 516*b* that are removably couplable to the first screen body 504*a* and the second screen body 504*b*, respectively. In one aspect, each of the two joining trims 516*a* and 516*b* are further secured to the first screen body 504*a* and the second screen body 504*b* using an adhesive or a two-sided tape. Each of the joining trims 516*a* and 516*b* also include protrusions extending from an end thereof that are dimensioned for coupling with respective apertures on the upper and lower mid rails, respectively, for vertical and lateral positioning. A first edge trim 518*a* is removably coupled to a first lateral edge portion of the first screen body 504*a* and a second edge trim 518*b* is removably coupled to a second lateral edge portion of the second screen body 504*b*.

The friction fit, interference fit or compression fit coupling between components of the privacy screens discussed above facilitate easier assembly or disassembly without the use of special tools. The components of the privacy screen, including the screen body, the rail, the cap trim, the joining trim, and the edge trims, may be coupled or decoupled from one another by overcoming the friction fit, interference fit or compression fit between components through application of manual force.

Further advantage is provided in that the shape of the privacy screen can be easily modified by attaching the different parts in a different configuration. As indicated above, the configuration of the screen body is in conformity with the configuration of the first rail and the second rail, where present. For instance, the S-shaped privacy screen 402 and C-shaped privacy screen 502 are comprised of the same parts with the difference being the configuration of the first rail, second rail and mid rails. Therefore, the S-shaped privacy screen 402 can be reconfigured into the C-shaped privacy screen 502 depending on the requirements of the user by replacing the first rail, second rail and mid rails of the S-shaped configuration with those of the C-shaped configuration. Other configurations for the privacy screen may be achieved using first rails, second rails and, where desired, mid rails having such other configurations.

The privacy screens discussed above are free-standing or self-supporting structures that can be placed on the floor of a room or any similar work surface. In another aspect, the privacy screens can be suspended from the ceiling of a room using any suitable means. The semi-rigid acoustic insulation material from which the privacy screens are fabricated is sufficiently stiff as to permit the structure to be self-supporting but sufficiently pliable as to permit the structures to be bent or deflected into desired configurations and to provide passage of the projections extending from the screen body into corresponding slots or apertures of the rails and caps with friction fit, interference fit or compression fit therebetween. Moreover, the semi-rigid acoustic insulation material is light weight. Preferably the privacy screen assembly may be relocated by a person simply picking it up and carrying it to a desired location. Further still, the acoustic insulation material absorbs acoustic waves. Thereby, the privacy screen assembly described herein reduces unwanted sound reverberation and controls background noise and interference within a space.

While the invention has been described in terms of specific aspects, it is apparent that other forms could be adopted by one skilled in the art. For example, the methods described herein could be performed in a manner which differs from the aspects described herein. The steps of each method could be performed using similar steps or steps producing the same result, but which are not necessarily equivalent to the steps described herein. Some steps may also be performed in different order to obtain the same result. Similarly, the apparatuses and systems described herein could differ in appearance and construction from the aspects described herein, the functions of each component of the apparatus could be performed by components of different construction but capable of a similar though not necessarily equivalent function, and appropriate materials could be substituted for those noted. Accordingly, it should be understood that the invention is not limited to the specific aspects described herein. It should also be understood that the phraseology and terminology employed above are for the purpose of disclosing the illustrated aspects, and do not necessarily serve as limitations to the scope of the invention.

What is claimed is:

1. A privacy screen comprising:

a first rail extending in a longitudinal direction, the first rail having a first support surface with a first plurality of apertures spaced apart along a length thereof;

a second rail extending in the longitudinal direction, the second rail having a second support surface with a second plurality of apertures spaced apart along a length thereof; and a screen body extending longitudinally between a first edge portion and a second edge portion opposite the first edge portion, the screen body further having an upper edge portion and a lower edge portion, each of the upper edge portion and the lower edge portion extending between the first and second edge portions, the screen body having a first plurality of spaced apart projections formed integrally therewith along the upper edge portion and a second plurality of spaced apart projections formed integrally therewith along the lower edge portion, wherein the first and second plurality of spaced apart projections extend outwardly of and away from the upper edge portion and lower edge portion, respectively, to define seating portions between the projections in the upper edge portion and the lower edge portion;

wherein each of the first plurality of projections is dimensioned for insertion into an aperture of the first plurality of apertures such that the seating portions between the first plurality of projections are flush with the first support surface of the first rail to affix the upper edge portion of the screen body to the first rail; and, wherein each of the second plurality of projections is dimensioned for insertion into an aperture of the second plurality of apertures such that the seating portions between the second plurality of projections are flush with the second support surface of the second rail to affix the lower edge portion of the screen body to the second rail.

2. The privacy screen of claim 1, wherein each of the first plurality of projections is dimensioned for insertion into the respective aperture of the first plurality of apertures in interference fit relation; and, wherein each of the second plurality of projections is dimensioned for insertion into the respective aperture of the second plurality of apertures in interference fit relation.

3. The privacy screen of claim 1, wherein the screen body conforms to a shape of the first rail and the second rail.

4. The privacy screen of claim 1, wherein the privacy screen is composed of a semi-rigid material.

5. The privacy screen of claim 4, wherein the semi-rigid material is one selected from the group consisting of polyethylene terephthalate (PET), polypropylene, and non-woven acoustic insulation material.

6. The privacy screen of claim 1, wherein the screen body comprises a plurality of grooves each extending between the upper edge portion and the lower edge portion.

7. The privacy screen of claim 6, wherein the plurality of grooves is formed on at least one of a front side and a rear side of the screen body.

8. The privacy screen of claim 6, wherein the plurality of grooves are parallel to one another and to the first and second edge portions between the upper edge portion and the lower edge portion.

9. The privacy screen of claim 1, further comprising a cap trim extending in the longitudinal direction and having a plurality of slots spaced apart therealong, wherein each slot of the plurality of slots is dimensioned for insertion of a respective projection of the first plurality of spaced apart projections of the screen body extending through a respective aperture of the first plurality of apertures of the first rail such that the cap trim is removably coupled with the projections and in abutment relationship with the first rail therealong.

10. The privacy screen of claim 9, wherein each slot of the plurality of slots is dimensioned for insertion of the respective projection of the first plurality of spaced apart projections of the screen body extending through the respective aperture of the first plurality of apertures of the first rail in interference fit relation.

11. The privacy screen of claim 1, further comprising:

a first edge trim removably couplable to the first edge portion of the screen body; and a second edge trim removably couplable to the second edge portion of the screen body.

12. The privacy screen of claim 11, wherein:

the first and second edge portions of the screen body include a plurality of tabs spaced apart therealong; and the first and second edge trims comprise a plurality of edge trim slots spaced apart along a length thereof, wherein each tab of the plurality of tabs is dimensioned for insertion into a respective edge trim slot of the plurality of edge trim slots to couple the first edge trim and the second edge trim to the first edge portion and the second edge portion, respectively.

13. The privacy screen of claim 12, wherein each tab of the plurality of tabs is dimensioned for insertion into the respective edge trim slot of the plurality of edge trim slots in interference fit relation.

14. The privacy screen of claim 11, wherein:

the first edge trim includes a first protrusion at a first end portion thereof and a second protrusion at a second end portion thereof;

the second edge trim includes a third protrusion at a first end portion thereof and a fourth protrusion at a second end portion thereof;

the first rail includes a first recess at a first end portion thereof and a second recess at a second end portion thereof;

the second rail includes a third recess at a first end portion thereof and a fourth recess at a second end portion thereof;

the first protrusion is dimensioned for insertion into the first recess such that the first end portion of the first edge trim is coupled to the first end portion of the first rail, and the second protrusion is dimensioned for insertion into the third recess such that the second end portion of the first edge trim is coupled to the first end portion of the second rail; and, the third protrusion is dimensioned for insertion into the second recess such that the first end portion of the second edge trim is coupled to the second end portion of the first rail, and the fourth protrusion is dimensioned for insertion into the fourth recess such that the second end portion of the second edge trim is coupled to the second end portion of the second rail.

15. The privacy screen of claim 14, wherein the first protrusion is insertable into the first recess in interference fit relation, and wherein the second protrusion is dimensioned for insertion into the third recess in interference fit relation; and wherein the third protrusion is dimensioned for insertion into the second recess in interference fit relation, and wherein the fourth protrusion is dimensioned for insertion into the fourth recess in interference fit relation.

16. The privacy screen of claim 11, wherein a width of the each of the first rail and the second rail is equal to a width of the first edge trim and the second edge trim.

17. A privacy screen comprising:

at least one upper rail and at least one lower rail, each extending in a longitudinal direction and having a support surface with a plurality of apertures spaced apart along a length thereof; and, at least one screen body extending longitudinally between a first edge portion and a second edge portion opposite the first edge portion, the at least one screen body further having an upper edge portion and a lower edge portion, each of the upper edge portion and the lower edge portion extending between the first and second edge portions, the at least one screen body having a plurality of spaced apart projections formed integrally therewith along the upper edge portion and the lower edge portion, wherein the plurality of spaced apart projections extend outwardly of and away from the upper edge portion and lower edge portion to define seating portions between the projections in the upper edge portion and the lower edge portion;

wherein the plurality of projections on the upper edge portion are dimensioned for insertion into the plurality of apertures on the at least one upper rail such that the seating portions between the projections are flush with the support surface of the at least one upper rail to affix the upper edge portion to the at least one upper rail; and, wherein the plurality of projections on the lower edge portion are dimensioned for insertion into the plurality of apertures on the at least one lower rail such that the seating portions between the projections are flush with the support surface of the at least one lower rail to affix the lower edge portion to the at least one lower rail.

18. The privacy screen of claim 17, wherein the plurality of projections on the upper edge portion are dimensioned for insertion into the plurality of apertures on the at least one upper rail in interference fit relation; and wherein the plurality of projections on the lower edge portion are dimensioned for insertion into the plurality of apertures on the at least one lower rail in interference fit relation.

19. The privacy screen of claim 17, wherein the at least one screen body comprises a first screen body and a second screen body.

20. The privacy screen of claim 19, further comprising at least one joining trim configured to removably couple the first screen body with the second screen body.

21. The privacy screen of claim 20, wherein the at least one joining trim is further secured to the first screen body and the second screen body using at least one of an adhesive and two-sided tape.

22. The privacy screen of claim 19, wherein:

the at least one upper rail comprises a first upper end rail, an upper mid rail, and a second upper end rail, wherein the upper mid rail is positionable between the first upper end rail and the second upper end rail along a portion of the upper edge portion of each of the first screen body and the second screen body; and the at least one lower rail comprises a first lower end rail, a lower mid rail, and a second lower end rail, wherein the lower mid rail is positionable between the first lower end rail and the second lower end rail along a portion of the lower edge portion of each of the first screen body and the second screen body.

23. The privacy of claim 22, further comprising at least one cap trim extending in the longitudinal direction and having a plurality of slots spaced apart therealong, wherein each slot of the plurality of slots is dimensioned for insertion of a respective projection of the plurality of spaced apart projections of the screen body extending through a respective aperture of the plurality of apertures of the at least one upper rail such that the at least one cap trim is removably coupled with the projections and in abutment relationship with the at least one upper rail therealong.

24. The privacy of claim 23, wherein each slot of the plurality of slots is dimensioned for insertion of the respective projection of the plurality of spaced apart projections of the screen body extending through the respective aperture of the plurality of apertures of the at least one upper rail in interference fit relation.

25. The privacy screen of claim 22, further comprising:

a first edge trim removably couplable to the first edge portion of the first screen body; and, a second edge trim removably couplable to the second edge portion of second screen body;

wherein the first edge trim is removably couplable to a first end portion of the first upper end rail and a first end portion of the first lower end rail; and, wherein he second edge trim is removably couplable to a second end portion of the second upper end rail and a second end portion of the second lower end rail.

26. A privacy screen kit comprising:

at least one upper rail extending in a longitudinal direction, the upper rail having a first support surface with a first plurality of apertures spaced apart along a length thereof;

at least one lower rail extending in the longitudinal direction, the lower rail having a second support surface with a second plurality of apertures spaced apart along a length thereof; and, at least one screen body extending longitudinally between a first edge portion and a second edge portion opposite the first edge portion, the at least one screen body further having an upper edge portion and a lower edge portion, each of the upper edge portion and the lower edge portion extending between the first and second edge portions, the at least one screen body having a plurality of spaced apart projections formed integrally therewith along the upper edge portion and the lower edge portion, wherein the plurality of spaced apart projections extend outwardly of and away from the upper edge portion and lower edge portion to define seating portions between the projections in the upper edge portion and the lower edge portion;

wherein the plurality of projections on the upper edge portion are dimensioned for insertion into the first plurality of apertures on the at least one upper rail, and the plurality of projections on the lower edge portion are dimensioned for insertion into the second plurality of apertures on the at least one lower rail to form a privacy screen structure.

27. The privacy screen kit of claim 26, wherein the plurality of projections on the upper edge portion are dimensioned for insertion into the first plurality of apertures on the at least one upper rail in interference fit relation, and the plurality of projections on the lower edge portion are dimensioned for insertion into the second plurality of apertures on the at least one lower rail in interference fit relation to form the privacy screen structure.

* * * * *